United States Patent [19]

Inoue

[11] Patent Number: 4,956,257

[45] Date of Patent: Sep. 11, 1990

[54] SILVER HALIDE PHOTOGRAPHIC MATERIAL AND METHOD FOR FORMING AN IMAGE

[75] Inventor: Nobuaki Inoue, Kanagawa, Japan

[73] Assignee: Fuji Photo Film Co., Ltd., Kanagawa, Japan

[21] Appl. No.: 239,377

[22] Filed: Sep. 1, 1988

[30]. Foreign Application Priority Data

Sep. 1, 1987 [JP] Japan ..... 62-218645

[51] Int. Cl.[5] ..... G03C 1/16; G03C 1/33

[52] U.S. Cl. ..... 430/264; 430/265; 430/267; 430/583; 430/584; 430/598; 430/600; 430/949

[58] Field of Search ..... 430/583, 598, 594, 600, 430/949, 265, 267, 264

[56] References Cited

U.S. PATENT DOCUMENTS

| | | | |
|---|---|---|---|
| 4,518,689 | 5/1985 | Noguchi et al. | 430/583 |
| 4,569,904 | 2/1986 | Okutsu et al. | 430/949 |
| 4,609,621 | 9/1986 | Sugimoto et al. | 430/583 |
| 4,681,836 | 7/1987 | Inoue et al. | 430/949 |
| 4,722,884 | 2/1988 | Inoue et al. | 430/446 |
| 4,755,448 | 7/1988 | Katoh | 430/600 |
| 4,786,587 | 11/1988 | Kuwabara | 430/598 |

FOREIGN PATENT DOCUMENTS 968112 1/1958 Fed. Rep. of Germany .

OTHER PUBLICATIONS

Patent Abstracts of Japan, vol. 10, No. 183, p. 472, Jun. 26, 1986 (JP-A-61-29837).

Patent Abstracts of Japan, vol. 11, No. 203, p. 591, Jul. 2, 1987 (JP-A-62-25745).

*Primary Examiner*—Paul R. Michl

*Assistant Examiner*—Thorl Chea

*Attorney, Agent, or Firm*—Sughrue, Mion, Zinn, Macpeak & Seas

[57] ABSTRACT

A negative silver halide photographic material composed of a support having thereon at least one chemically sensitized silver halide emulsion layer at least one hydraophilic colloidal layer containing a hydrazine derivative and a compound having substantially all absorption maxima outside the visible light region represented by formula (I):

(I)

wherein $Z^{11}$ and $Z^{12}$ each represents a non-metallic atomic group necessary for completing a substituted or unsubstituted heterocyclic ring selected from benzoxazole, benzothiazole, benzoselenazole, naphthoxazole, naphthothiazole, naphthoselenazole, thiazole, thiazoline, oxazole, selsnazole, selsnazoline, pyridine, benzimidazole, and quinoline; $R^{11}$ and $R^{12}$ each represents a substituted or unsubstituted alkyl group, provided that at least one of them is substituted with an acid radical; X represents a counter ion necessary for charge balance; and n is 0 or 1.

The photographic material exhibits high sensitivity and provides an image having high contrast and high density, with neither black pepper nor residual color in the non-image area.

21 Claims, No Drawings

SILVER HALIDE PHOTOGRAPHIC MATERIAL AND METHOD FOR FORMING AN IMAGE

FIELD OF THE INVENTION

This invention relates to a silver halide photographic material, and more particularly to a highly sensitive negative silver halide photographic material which provides a high contrast and high density image free from black pepper.

BACKGROUND OF THE INVENTION

It is known that a photographic image having ultra-high contrast can be formed using a certain silver halide, and such a technique is used in the field of photographic printing plate making.

For example, it is known that a line image or a dot image having high contrast and high blackening density in which the image area and non-image area can be clearly distinguished can be obtained by developing a lith film with a silver chlorobromide emulsion containing at least mol % of silver chloride in a hydroquinone developer containing, as a preservative, a sulfite ion in a concentration controlled at an extremely low level, usually not more than 0.1 mol/l. Since such a developer is extremely susceptible to air oxidation due to the low sulfite concentration in the developer, various attempts have been made in order to maintain the stability of the developing activity.

In order to overcome instability in image formation according to the above-described lith development system, an image formation system is desired in which a processing solution having satisfactory preservability is used to obtain ultra-high contrast. It has been proposed to process a surface latent image type silver halide photographic material containing a specific acylhydrazine compound with a developer having a pH of from 11.0 to 12.3 and containing 0.15 mol/l or more of a sulfite preservative which exhibits satisfactory preservation stability, to form a negative image of ultra-high contrast having a gamma exceeding 10, as described in U.S. Pat. Nos. 4,166,742, 4,168,977, 4,221,857, 4,224,401, 4,243,739, 4,272,606, 4,311,781, and 4,269,929. This image formation system has the further advantage that not only silver chlorobromide but silver iodobromide and silver chloroiodobromide can be employed, while conventional ultra-high contrast image formation systems are applicable only to silver chlorobromide having a high silver chloride content.

In general, the smaller the silver halide grains in silver halide photographic materials, the higher the blackening density obtained per unit of developed silver. In contrast, the greater the silver halide grain size, the higher the sensitivity. Therefore, achievement of both high sensitivity and high blackening density requires an increase of the content of a silver halide emulsion having a large grain size per unit area. However, a light-sensitive material having a large content of a silver halide emulsion require additional time in fixation, washing, and drying, preventing rapid processing. In addition, from the standpoint of the expensiveness of silver and limits in silver production and deposits, it is necessary to produce light-sensitive materials using a reduced amount of silver, i.e. as low as possible.

From all these considerations, studies on silver halide light-sensitive materials exhibiting high image density and high sensitivity with a reduced amount of silver have been conducted for years.

The above-described image formation system not only brings about marked improvements in sensitivity and contrast but sometimes causes an unfavorable phenomenon, called "black pepper", due to infectious development, which has presented a serious problem in the printing plate making process. The term "black pepper" as used herein means black spots of fine developed silver appearing on non-image areas (unexposed areas). Formation of black pepper frequently occurs with a decrease of sulfite ion concentration in a developer, as a preservative or an increase of the pH of the developer, resulting in considerable reduction of the commercial value of a light-sensitive material for printing plate making. Although great efforts have been made to overcome this problem, conventional techniques for eliminating black pepper are often accompanied by a reduction of sensitivity, maximum density, and gamma. Accordingly, a system free from black pepper while retaining high sensitivity and high contrast is eagerly sought.

Systems of using a chemically sensitized emulsion in combination with a hydrazine compound are disclosed in JP-A-Nos.60-83028, 61-29837, and 61-47942. They are markedly effective to obtain a high maximum density, but suffer from serious black pepper.

A combination of the compound represented by formula (I) below and a hydrazine compound was previously described in JP-A-No. 61-29837, but the disclosure does not refer to a combination with a chemically sensitized emulsion, and particularly a chemically sensitized silver iodobromide emulsion. U.S. Pat. Nos. 4,681,836 and 4,737,442 discloses hydrazine compounds. Further, U.S. Pat. No. 4,147,547 discloses the compound of formula (I) as a fog inhibitor for color silver halide photographic materials, and JP-A-Nos. 62-237445, 2-280733 and 62-280734 disclose the compound of formula (I).

Further, in the above described image formation system, a sensitizing dye added with the aim of increasing sensitivity has a remarkable influence upon gamma or black pepper appearance. JP-A-No. 61-29837 (the term "JP-A" as used herein means an "unexamined published Japanese patent application") discloses dyes which improve black pepper without causing reduction of gamma. These dyes, however, are attended by color remaining after development processing when used in an amount sufficient for achieving appreciable improvement of black pepper.

SUMMARY OF THE INVENTION

One object of this invention is to provide a highly sensitive silver halide photographic material providing a high contrast (e.g., a gamma of 10 or more) and a high blackening density without causing black pepper.

Another object of this invention is to provide a silver halide photographic material free from residual color.

It has now been found that these and other objects of this invention can be accomplished by a negative silver halide photographic material composed of a support having thereon at least one chemically sensitized silver halide emulsion layer, at least one hydrophilic colloidal layer of the material containing a hydrazine derivative and a substantially colorless compound having substantially all absorption maxima outside the visible light region represented by formula (I):

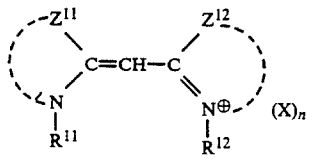

(I)

wherein $Z^{11}$ and $Z^{12}$, which may be the same or different each represents a non-metallic atomic group necessary for completing a substituted or unsubstituted heterocyclic ring selected from benzoxazole, benzothiazole, benzoselenazole, naphthoxazole, naphthothiazole, naphthoselenazole, thiazole, thiazoline, oxazole, selenazole, selenazoline, pyridine, benzimidazole, and quinoline; $R^{11}$ and $R^{12}$, which may be the same or different; each represents a substituted or unsubstituted alkyl group, provided that at least one of $R^{11}$ and $R^{12}$ is substituted with an acid group; X represents a counter ion required for charge balance; and n is 0 or 1.

The invention also relates to a method for forming an image by the stops of imagewise exposing the above-described light-sensitive material to light and developing the exposed material with a developer solution having a sulfite ion concentration of at least 0.15 mol/l and a pH of from 10.5 to 12.3.

DETAILED DESCRIPTION OF THE INVENTION

In formula (I), substituents for the heterocyclic ring formed by $Z^{11}$ or $Z^{12}$ include a halogen atom (e.g., fluorine, chlorine, bromine, and iodine), a nitro group, an alkyl group preferably having up to 4 carbon atoms (e.g., methyl, ethyl, trifluoromethyl, benzyl, and phenethyl), an aryl group (e.g., phenyl), an alkoxy group preferably having up to 4 carbon atoms (e.g., methoxy, ethoxy, propoxy, and butoxy), a carboxyl group, an alkoxycarbonyl group preferably having from 2 to 5 carbon atoms (e.g., ethoxycarbonyl), a hydroxyl group, and a cyano group.

Specific examples of the benzoxazole nucleus are benzoxazole, 5-chlorobenzoxazole, 5-methylbenzoxazole, 5-bromobenzoxazole, 5-fluorobenzoxazole , 5-phenylbenzoxazole, 5-methoxybenzoxazole, 5-ethoxybenzoxazole, 5-trifluoromethylbenzoxazole, 5-hydroxybenzoxazole, 5carboxybenzoxazole, 6-methoxybenzoxazole, 6-hydroxybenzoxazole, and 5,6-dimethylbenzoxazole. Specific examples of the benzothiazole nucleus are benzothiazole, 5 -chlorobenzothiazole, 5-nitrobenzothiazole, 5-methylbenzothiazole, 6-bromobenzothiazole, 5-iodobenzothiazole, 5-phenylbenzotiazole, 5-methoxybenzothiazole, 6-methxybenzothiazole, 5-carboxybenzothiazole, 5-ethoxycarbonylbenzothiazole, 5-fluorobenzothiazole, 5-chloro-6-methylbenzothiazole, and 5-trifluoromethyl-benzothiazole. Specific examples of the benzoselenazole nucleus are benzoselenazole, 5-chlorobenzoselenazole, 5-methoxybenzoselenazole, 5-hydroxybenzoselenazole, and 5-chloro-6-methylbenzoselenazole. Specific examples of the naphthoxazole nucleus are naphtho[2,1-d]oxazole, naphtho[1,2-d]oxazole, naphtho[2,3-d]oxazole, and 5-methoxynaphtho[1,2-d]oxazole. Specific examples of the naphthotiazole nucleus are naphtho[2,1-d]-thiazole, naphtho[1,2-d]thiazole, naphtho[2,3-d]-thiazole, 5-methoxynaphtho[1, 2-d]thiazole, and 5 -methoxynaphtho[2,3d]thiazole. Specific examples of the naphthoselenazole nucleus are naphtho[1,2-d]-selenazole and naphtho[2,1-d]selenazole. Specific examples of the thiazole nucleus are thiazole, 4-methilthiazole, 4-phenylthiazole, and 4,5-dimethylthiazole. Specific examples of the thiazoline nucleus are thiazoline and 4-methylthiazoline. Specific examples of the oxazole nucleus are exazole, 4-methyloxazole, 4-phenyloxazole, 4-methoxyoxazole, 4,5-dimethyloxazole, 5-phenylloxazole, and 4-methoxyoxazole. Specific examples of the pyridine nucleus are 2-pyridine, 4-pyridine, 5-methyl-2-pyridine, and 3-methyl-4-pyridine. Specific examples of the benzimidazole nucleus are 5,6-dichloro-1-ethylbenzimidazole and 6-chloro-1-ethyl-5 -trifluoromethylbenzimidazole. Specific examples of the quinoline nucleus are 2-quinoline, 4-quinoline, 3-methyl-2-quinoline, 5-ethyl-2-quinoline, 8-fluoro-2-quinoline, 6-methoxy-2-quinoline, 8-chloro-4-quinoline, and 8-methyl-4-quinoline.

Among them, preferred are benzoxazole, benzothiazole, naphthoxazole, naphthothiazole, thiazole, and oxazole nuclei. More preferred are benzoxazole, benzothiazole and naphthoxazole nuclei, with benzoxazole and naphthoxazole nuclei being the most preferred.

$R^{11}$ and $R^{12}$ represents a substituted or unsubstituted alkyl group, and at least one of them contains an acid group, such as a sulfo group and a carboxyl group.

The unsubstituted alkyl group preferably contains 18 or less, more preferably 8 or less, carbon atoms, and includes methyl, ethyl, n-propyl, n-butyl, n-hexyl, and n-octadecyl groups. The substituted alkyl group preferably contains 6 or less, more preferably 4 or less, carbon atoms in the alkyl moiety, and includes an alkyl group substituted with a sulfo group bonded either directly or via an alkoxy group or an aryl group (e.g., 2-sulfoethyl, 3-sulfopropyl, 3-sulfobutyl, 4-sulfobutyl, 2-(3-sulfopropoxy)ethyl, 2-[2-(3-sulfopropoxy)ethoxy]-ethyl, 2 hydroxy-3-sulfopropyl, p-sulfophenethyl, and p-sulfophenylpropyl; an alkyl group substituted with a carboxyl group bonded either directly or via an alkoxy group or an aryl group, etc. (e.g., carboxymethyl, 2-carboxyethyl, 3-carboxypropyl, and 4-carboxybutyl); a hydroxyalkyl group (e.g., 2-hydroxyethyl and 3-hydroxypropyl); an acyloxyalkyl group (e.g., 2-acetoxyethyl and 3-acetoxypropyl); an alkoxyalkyl group (e.g., 2-methoxyethyl and 3-methoxypropyl); an alkoxycarbonylalkyl group (e.g., 2-methoxycarbonylethyl, 3-methoxycarbonylpropyl, and 4-ethoxycarbonylbutyl; a vinyl-substituted alkyl group (e.g., allyl); a cyanoalkyl group (e.g., 2-cyanoethyl); a carbamoylalkyl group (e.g., 2-carbamoylethyl); an aryloxyalkyl group (e.g., 2-phenoxyethyl and 3-phenoxypropyl); an aralkyl group (e.g., 2-phenethyl and 3-phenylpropyl); and an aryloxyalkyl group (e.g., 2-phenoxyethyl and 3-phenoxypropyl).

The counter ion X is an anion capable of offsetting the positive charge of the quaternary ammonium salt in the heterocyclic ring and includes, for example, a bromine ion, a chlorine ion, an iodine ion, a p-toluenesulfonate ion, an ethylsulfonate ion, a perchlorate ion, a trifluoromethanesulfonate ion, and a thiocyanate ion. In this case, n in formula (I) is 1.

In cases where either one of $R^{11}$ and $R^{12}$ contains an anionic substitutent, such a sulfoalkyl group, the compound can take the form of a betaine. In these case $R^{11}$ and $R^{12}$ both contain such an anionic substitutent, the counter ion X is a cation, such as an alkali metal ion (e.g., sodium ion and potassium ion) and an ammonium salt ion (e.g., triethylammonium).

The term "a compound having substantially all absorption maxima outside the visible light region" as used herein means a compound which causes no practical problem of residual color in non-image areas of the light-sensitive material after development processing. Such a compound preferably has an absorption maximum in methanol at 460 nm or less, more preferably at 430 nm or less.

The compound represented by formula (I) used in the present invention is disclosed, for example, in U.S. Pat. Nos. 2,852,385; 2,694,638; 3,615,635; 2,912,329; 3,364,031; 3,397,060; 3,506,443 and British Pat. No. 1,339,833. The compound represented by formula (I) is easily synthesized by a process disclosed in the above publications or F. M. Hamer, *The cyanine Dyes and Related Compounds*, Interscience Publishers, New York (1964).

Specific examples of the compound represented by formula (I) are shown below, but the present invention is not to be construed as being limited thereto:

I-1

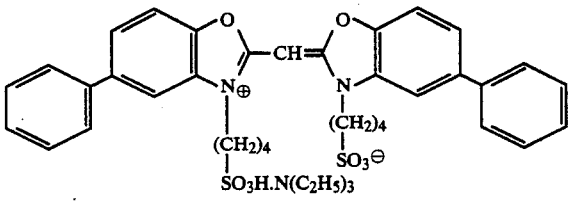

I-2

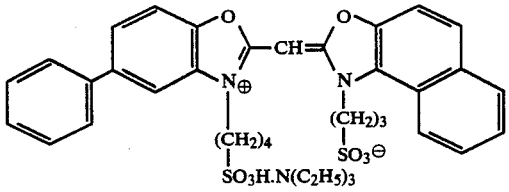

I-3

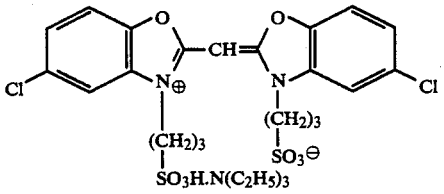

I-4

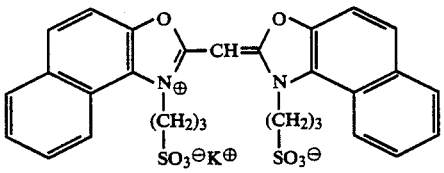

I-5

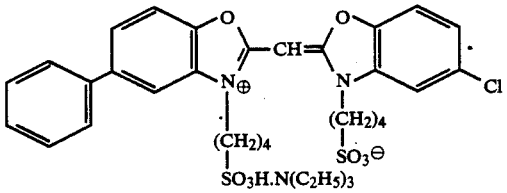

-continued

I-6

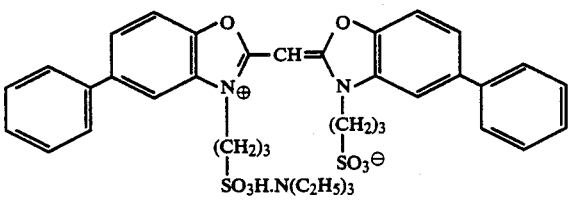

I-7

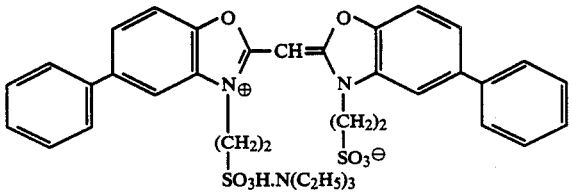

I-8

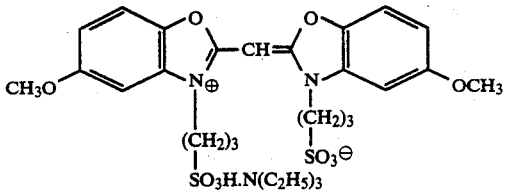

I-9

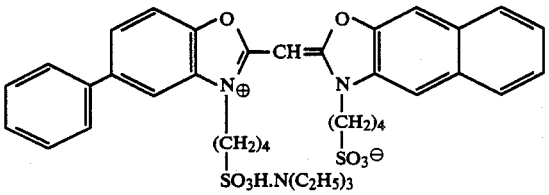

I-10

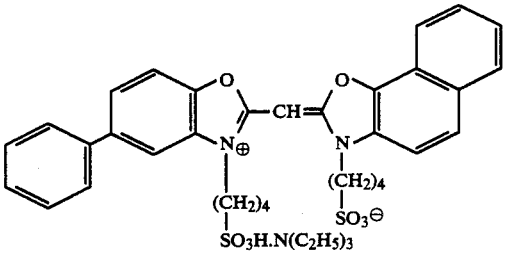

I-11

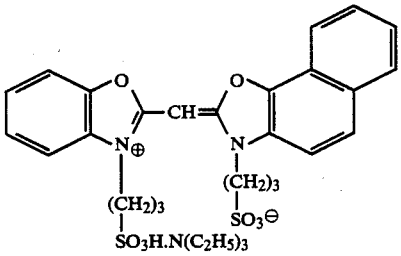

I-12

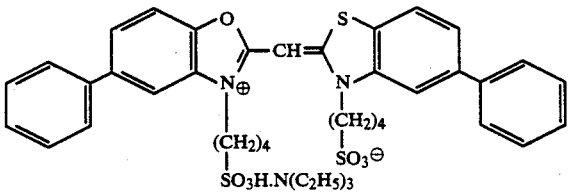

-continued
I-13
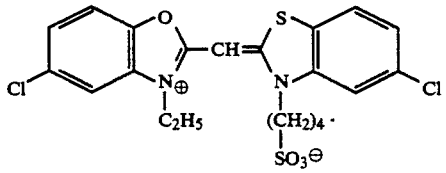
I-14
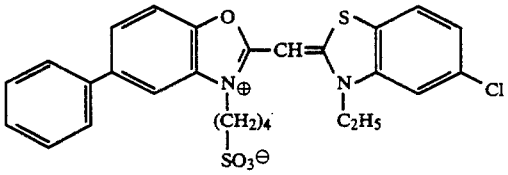
I-15
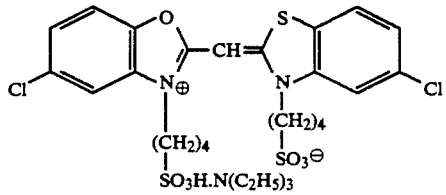
I-16
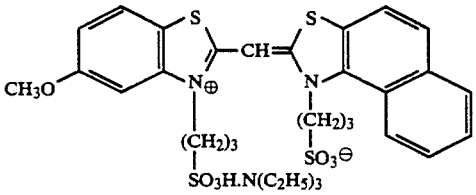
I-17
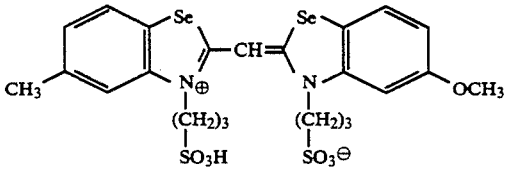
I-18
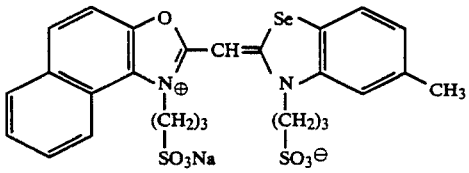
I-19
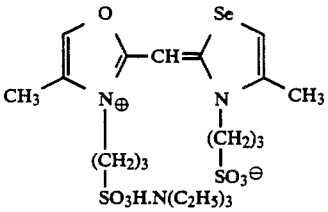
I-20
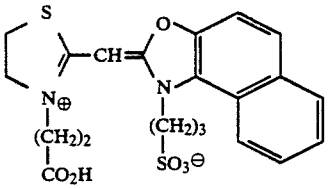
-continued
I-21
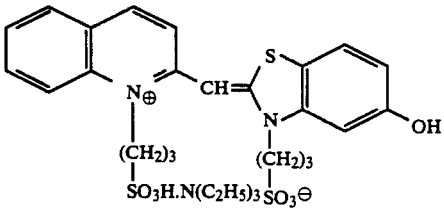
I-22
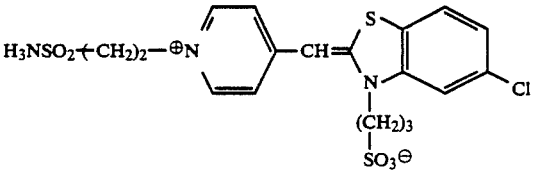
I-23
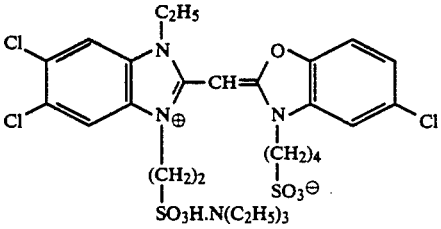
I-24
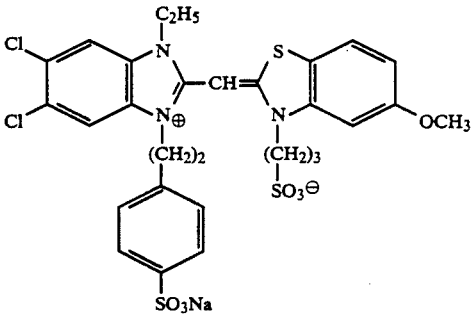
I-25
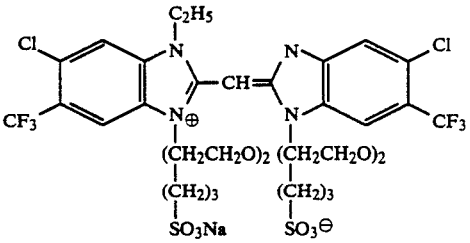
I-26
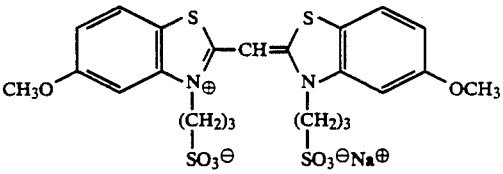
The hydrazine derivative which can be used in the present invention preferably represented by formula (II):
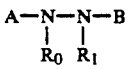
(II)

wherein A represents an aliphatic group or an aromatic group; B represents a formyl group, an acyl group, an alkylsulfonyl or arylsulfonyl group, an alkylsulfinyl or arylsulfinyl group, a carbamoyl group, an alkoxycarbonyl or aryloxycarbonyl group, a sulfinamoyl group, an alkoxysulfonyl group, a thioacyl group, a thiocarbamoyl group, a sulfamoyl group, or a heterocyclic group; and $R_0$ and $R_1$, which may be the same or different, each represents hydrogen, a substituted or unsubstituted alkylsulfonyl group, a substituted or unsubstituted arylsulfonyl group, or a substituted or unsubstituted acyl group, provided that at least one of $R_0$ and $R_1$ represents hydrogen; or B and $R_1$ may be connected to each other to form a partial structure of a hydrazone structure

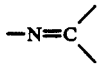

together with the adjacent nitrogen atom.

In formula (II), the aliphatic group represented by A preferably contains from 1 to 30 carbon atoms and more preferably represents a substituted or unsubstituted straight chain or branched or cyclic alkyl group having from 1 to 20 carbon atoms. The branched alkyl group may be cyclized to form a saturated hetero ring containing at least one hetero atom. The substituent for the alkyl group includes an aryl group, an alkoxy group, a sulfoxy group, a sulfonamido group, and a carbonamido group.

Specific examples of the alkyl group for A include t-butyl, n-octyl, t-octyl, cyclohexyl, pyrrolidyl, imidazolyl, tetrahydrofuryl, and morpholino groups.

The aromatic group represented by A is a substituted or unsubstituted monocyclic or bicyclic aryl group or a substituted or unsubstituted unsaturated heterocyclic group. The unsaturated heterocyclic group may be condensed with a monocyclic or bicyclic aryl group to form a heteroaryl group. Of these, preferred as A is an aryl group.

Specific examples of the aromatic group include a benzene ring, a naphthalene ring, a pyridine ring, a pyrimidine ring, an imidazole ring, a pyrazole ring a quinoline ring, an isoquinoline ring, a benzimidazole ring, a thiazole ring or a benzothiazole ring. Of these, those containing a benzene ring are preferred. Typical substituents for the aromatic group include a straight or branched chain or cyclic alkyl group (preferably having from 1 20 carbon atoms), an aralkyl group (preferably containing a monocyclic or bicyclic aryl moiety and an alkyl moiety having from 1 to 3 carbon atoms), an alkoxy group (preferably having from 1 to 20 carbon atoms), a substituted amino group (preferably substituted by an alkyl group having from 1 to 20 carbon atoms), an acylamino group (preferably having from 2 to 30 carbon atoms, a sulfonamido group (preferably having from 1 to 30 carbon atoms) and a ureido group (preferably having from 1 to 30 carbon atoms).

Of these groups, a particularly preferred group A is an aryl group.

The aliphatic or aromatic group represented by A may contain a ballast group commonly employed in immobile photographic additives, such as couplers. The ballast group is selected from groups that contain 8 or more carbon atoms, and relatively inert with respect to photographic characteristics, such as an alkyl group, an alkoxy group, a phenyl group, an alkylphenyl group, a phenoxy group and an alkylphenoxy group.

The aliphatic or aromatic group represented by A may further contain a group capable of adsorbing onto silver halide grains. Such an adsorptive group includes those described in U.S. Pat. Nos. 4,385,108 and 4,459,347, JP-A-Nos.59-195233, 59-200231, 59-201045, 59-201046, 59201047, 59-202048, and 59-201049, and Japanese Patent Application Nos. 59-36788, 60-11459, and 60-19739, such as a thiourea group, a heterocyclic thioamido group, a mercapto heterocyclic group and a triazole group.

B specifically represents a formyl group, an acyl group (e.g., acetyl, propionyl, trifluoroacetyl, chloroacetyl, benzoyl, 4-chlorobenzoyl, pyruvoyl, methoxalyl and methyloxamoyl), an alkylsulfonyl group (e.g., methanesulfonyl and 2-chloroethanesulfonyl), an arylsulfonyl group (e.g., benzenesulfonyl), an alkylsulfinyl group (e.g., methanesulfinyl group), an arylsulfinyl group (e.g., benzenesulfinyl), a carbamoyl group (e.g., methylcarbamoyl and phenylcarbamoyl), a sulfamoyl group (e.g., a dimethylsulfamoyl), an alkoxycarbonyl group (e.g., methoxycarbonyl and methoxyethoxycarbonyl), an aryloxycarbonyl group (e.g., phenoxycarbonyl), a sulfinamoyl group (e.g., methylsulfinamoyl), an alkoxysulfonyl group (e.g., methoxysulfonyl and ethoxysulfonyl), a thioacyl group (e.g., methylthiocarbonyl), a thiocarbamoyl group (e.g., methylthiocarbamoyl), or a heterocyclic group (e.g., pyridine).

Of these groups, preferred as B is a formyl group or an acyl group.

B, $R_1$ and nitrogen atom to which they are bonded may be taken together to form a partial structure of a hydrazone structure

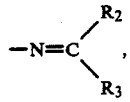

wherein $R_2$ represents an alkyl group, an aryl group or a heterocyclic group; and $R_3$ represents hydrogen, an alkyl group, an aryl group or a heterocyclic group.

$R_0$ and $R_1$ each represents hydrogen an alkyl- or arylsulfonyl group having up to 20 carbon atoms (preferably a phenylsulfonyl group or a phenylsulfonyl group substituted so as to have a total Hammett's value of at least −0.5), or an acyl group having up to 20 carbon atoms (preferably a benzoyl group or a benzoyl group substituted so as to have a total Hammett's value of at least −0.5, or a substituted or unsubstituted straight chain, branched, or cyclic aliphatic acyl group, the substituent therefor including a halogen atom, an ether group, a sulfonamido group, a carbonamido group, a hydroxyl group, a carboxyl group, and a sulfo group). The most preferred group as $R_O$ or $R_1$ is hydrogen.

Additional examples of the hydrazine derivatives which can be used in the present invention are described in *Research Disclosure,* 23516, P346 (Nov., 1983) and publications cited therein, U.S. Pat. Nos. 4,080,270, 4,269,929, 4,276,364, 4,278,748, 4,385,108, 4,459,347, 4,560,638, and 4,478,928, British Patent No. 2,011,391B, and JP-A-No.60-179734.

Specific examples of the hydrazine derivatives of formula (II) are shown below, but the present invention is not be construed as being limited thereto.

(II-1)
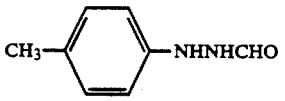
(II-2)
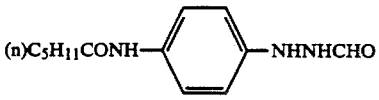
(II-3)
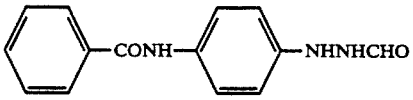
(II-4)
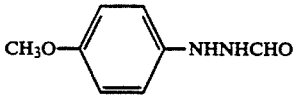
(II-5)
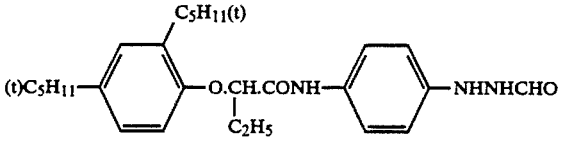
(II-6)
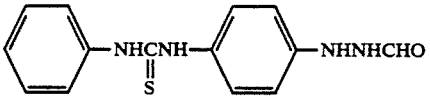
(II-7)
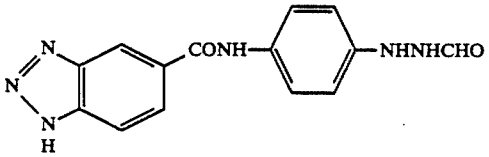
(II-8)
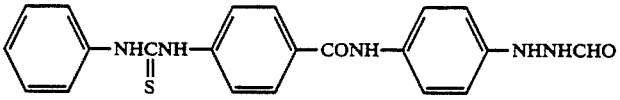
(II-9)
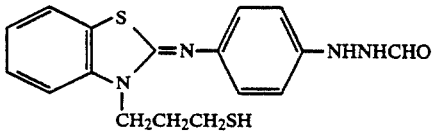
(II-10)
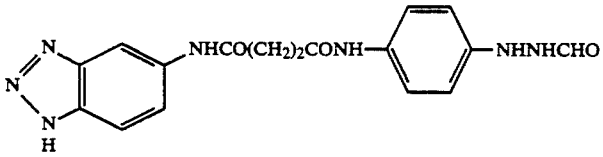
(II-11)
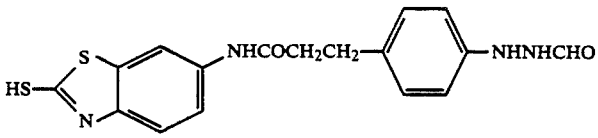

-continued
(II-12)
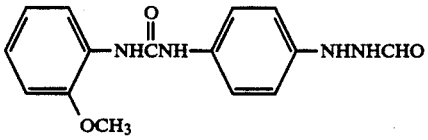
(II-13)
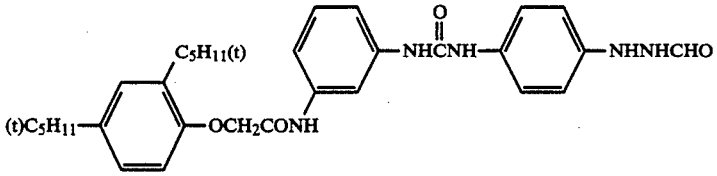
(II-14)
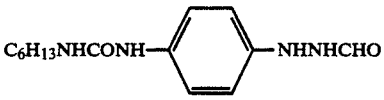
(II-15)
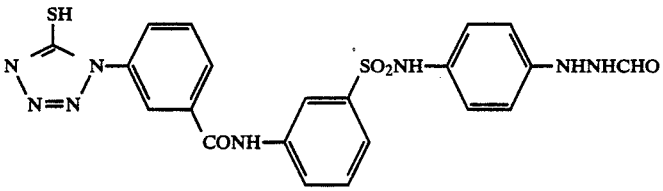
(II-16)
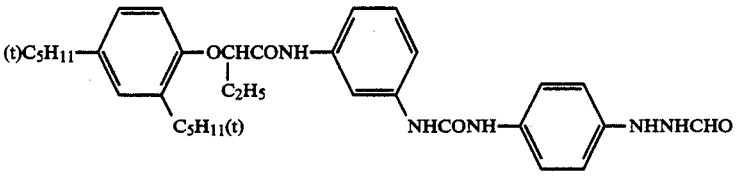
(II-17)
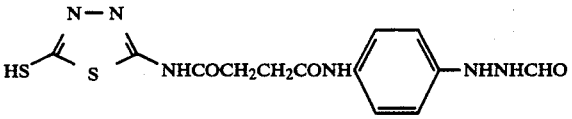
(II-18)
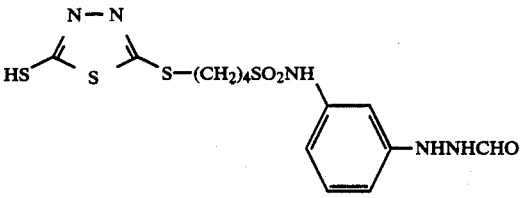
(II-19)
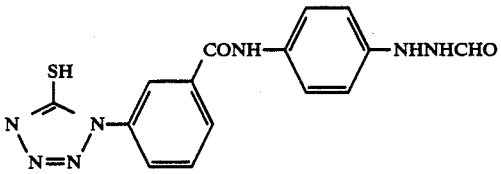
(II-20)
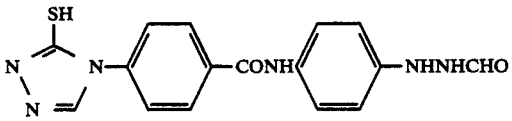
(II-21)
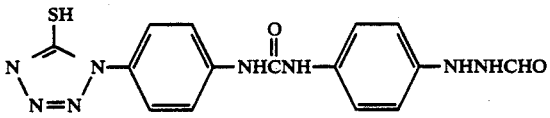

-continued
(II-22)
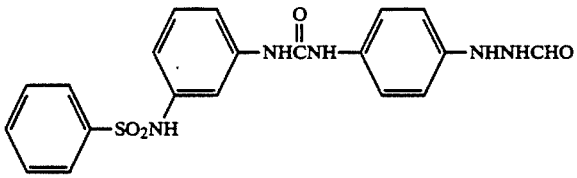
(II-23)
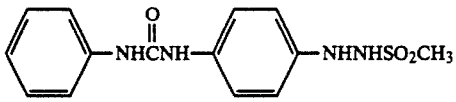
(II-24)
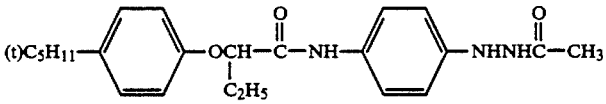
(II-25)
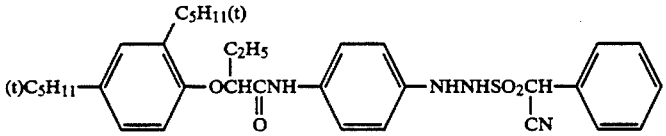
(II-26)
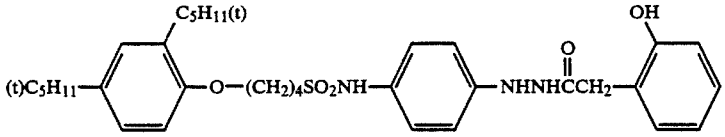
(II-27)
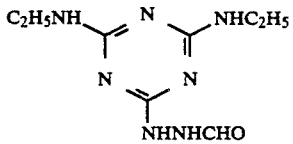
(II-28)
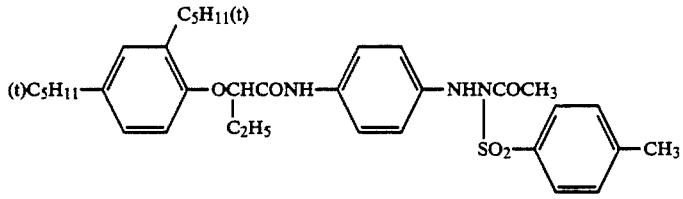
(II-29)
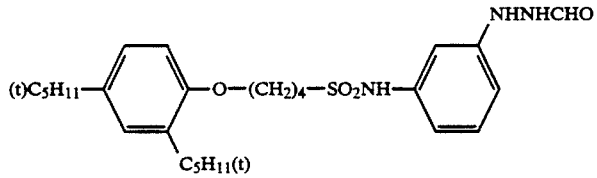
(II-30)
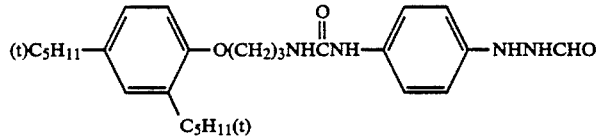
(II-31)
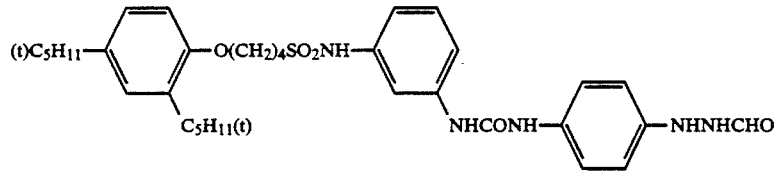
The compound of formula (I) and the hydrazine derivative according to the present invention are preferably incorporated in a silver halide emulsion layer, but may be incorporated in any light-insensitive hydrophilic colloidal layers, such as a protective layer, an intermediate layer, a filter layer, an anti-halation layer, and the like. Incorporation of these compounds can be carried out by dissolving each of them in water in case of using a water-soluble compound or in a water-miscible organic solvent, e.g., alcohols, esters, ketones, etc., in case of using a sparingly water soluble compound, and adding the solution to a hydrophilic colloidal solution. When it is added to a silver halide emulsion layer, addition may be effected at any stage, from the commencement of chemical ripening up to the stage immediately before coating, and preferably from the end of chemical ripening to the stage before coating. In particular, the compound is preferably added to a coating composition ready to be coated.

The amount of the compound of formula (I) to be added is desirably selected to obtain optimal results depending on the grain size and halogen composition of the silver halides, the method and degree of chemical sensitization, the relationship between the layer to which the compound is added and the silver halide emulsion layer, the kind of antifoggant used, and the like. Such selection can be made easily by one skilled in the art. Typically the compound of formula (I) is preferably used in an amount of from $10^{-6}$ to $1\times10^{-2}$ mol, and more preferably from $1\times10^{-5}$ to $5\times10^{-3}$ mol, per mol of the total silver halide of the photographic material.

The hydrazine derivative of formula (II) can be incorporated into the silver halide photographic material in the same manner as for the compound of formula (I). The amount to be incorporated preferably ranges from $1\times10^{-6}$ to $1\times10^{-1}$ mol, more preferably from $1\times10^{-5}$ to $4\times10^{-3}$ mol, per mol of the total silver halide.

Silver halide emulsions which can be used in the present invention may have any halogen composition, including silver chloride, silver chlorobromide, silver iodobromide, and silver iodochlorobromide, with silver iodobromide being preferred. Silver halide grains containing not more than 10 mol %, and particularly from 0.4 to 3.5 mol %, of silver iodide are preferred.

The silver halide grains to be used preferably have a small mean diameter (e.g., not more than 0.7 μm), and preferably a diameter of not more than 0.5 μm, most preferably a diameter of from 0.2 to 0.4 μm. The grain size distribution is not particularly limited, but mono-disperse emulsions are preferred. The term "mono-disperse" as used herein means that at least 95% of the total weight or number of silver halide grains is in a size range within ±40% of the mean grain size and more preferably a size range within ±20% of the mean grain size.

The silver halide grains may have a regular crystal form, such as cubic, octahedral, tetracahedral and rhombic dodecahedral forms, with cubic or tetradechedral grains being particularly preferred, or an irregular crystal form, e.g., a spherical form, a plate-like form, and a tabular form having an aspect ratio of from 3 to 20, or may have a composite crystal form thereof.

The silver halide grains may have a homogeneous phase throughout the individual grains or a heterogeneous phase having a core-shell structure. Two or more silver halide emulsions separately prepared may be used as a mixture.

In the course of grain formation or physical ripening, a cadmium salt, a sulfite, a lead salt, a thallium salt, a rhodium salt or a complex salt thereof, an iridium salt or a complex salt thereof may be present in the system.

A silver halide which is particularly suitable for use in this invention is silver haloiodide whose surface portion has a greater silver iodide content than the average iodide content of individual grains, which is prepared in the presence of from $10^{-8}$ to $10^{-5}$ mol of an iridium salt or a complex salt thereof per mol of silver. Use of an emulsion containing such a silver haloiodide brings about higher sensitivity and higher gamma. It is preferred to add the prescribed amount of the iridium salt by the end of physical ripending, and more particularly during grain formation. The iridium salt to be added includes a water-soluble iridium salt or a complex salt thereof, e.g., iridium trichloride, iridium tetrachloride, potassium hexachloroiridate (III), potassium hexachloroiridate (IV), and ammonium hexachloroiridate (III).

The silver halide emulsion used in the light-sensitive material may be a single kind or two or more kinds differing, for example, in mean grain size, halogen composition, crystal habit, or condition of chemical sensitization. When two kinds of a silver halide emulsion are used, it is preferable for increasing maximum density to use two kinds of mono-disperse emulsions differing in average grain size as disclosed in Japanese Patent Application Nos. 60-64199 and 60-232086. The smaller mono-disperse grains are preferably subjected to chemical sensitization, preferably sulfur sensitization. The larger mono-disperse grains may or may not be chemically sensitized. Since large mono-disperse grains generally tend to cause black pepper, it is preferred that they are not subjected to chemical sensitization at all, or the chemical sensitization should be effected lightly so that no black pepper occurs, by making the time of chemical sensitization shorter, employing lower temperatures or controlling the amount of a chemical sensitizer to be used as compared with the chemical sensitization of the smaller grains. The difference in sensitivity between the larger mono-disperse emulsion and the smaller mono-disperse emulsion is not particularly limited, but preferably ranges from 0.1 to 1.0, more preferably from 0.2 to 0.7, expressed in ΔlogE, with the sensitivity of the larger size emulsion being preferably higher.

The silver halide emulsion layer may be composed of a single layer or multiple layers. In the latter case, the emulsions may be the same or different.

Binders or protective colloids for photographic emulsions include gelatin to advantage and, in addition, other hydrophilic colloids, such as proteins, e.g., gelatin derivatives, grafted polymers of gelatin and other high polymers, albumin, casein; cellulose derivatives, e.g., hydroxyethyl cellulose, carboxymethyl cellulose, cellulose sulfate; sugar derivatives, e.g., sodium alginate, starch derivatives; and a wide variety of synthetic hydrophilic high polymers, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, or copolymers of monomers constituting these homopolymers.

The gelatin used includes not only lime-processed gelatin but acid-processed gelatin, hydrolysis products of gelatin, and enzymatic decomposition products of gelatin.

The silver halide emulsion used in the invention is subjected to chemical sensitization. Chemical sensitization can be carried out by any of sulfur sensitization, reduction sensitization, noble metal sensitization and a combination thereof. Among these techniques, sulfur sensitization is preferred.

Sulfur sensitization is effected by using sulfur compounds contained in gelatin and other various sulfur compounds, such as thiosulfates, thioureas, thiazoles and rhodanines. Specific examples of these sulfur sensitizers are described in U.S. Pat. Nos. 1,574,944, 2,278,947, 2,410,689, 2,728,668, 3,501,313, and 3,656,955. Of these, preferred are thiosulfates and thioureas. The pAg value during the sulfur sensitization is preferably controlled at 8.3 or less, more preferably between 7.3 and 8.0. A combined use of polyvinylpyrrolidone and a thiosulfate as reported by Moisar, Klein *Gelatine Proc. Symp.*, 2nd ed., 301–309 (1970) is also advantageous.

Noble metal sensitization is typically carried out by gold sensitization using gold compounds, mostly gold complex salts. Complex salts of noble metals other than gold, e.g., platinum, palladium and iridium, may also be used. Specific examples of gold sensitization are described, e.g., in U.S. Pat. No. 2,448,060 and British Patent No. 618,061.

Reduction sensitization is effected by using a reducing agent, such as stannous salts, amines, formamidinesulfinic acid, and silane compounds. Specific examples of reduction sensitization are given in U.S. Pat. Nos. 2,487,850, 2,518,698, 2,983,609, 2,983,610, and 2,694,637.

The photographic emulsion can also be spectrally sensitized so as to have sensitivity to the longer wavelength region by the use of sensitizing dyes having an absorption maximum in the visible region as described in JP-A-55-52050, pp. 45–53 (e.g., cyanine dyes and merocyanine dyes).

These sensitizing dyes may be used either individually or in combinations thereof. Combinations of sensitizing dyes are frequently employed for the particular purpose of supersensitization. The emulsion may further contain, in combination with the sensitizing dyes, a dye or substance producing a supersensitizing effect, though showing no spectral-sensitizing activity by itself or no substantial absorption of visible light. Examples of useful sensitizing dyes, combinations of dyes for supersensitization, and substances producing supersensitizing effects are described in *Research Disclosure*, Vol. 176, No. 17643, p23, IV-J (Dec., 1978).

The light-sensitive materials according to the present invention can contain various compounds for the purpose of preventing fog during preparation, preservation or photographic processing of the light-sensitive materials or for stabilizing photographic performance. Such compounds include azoles, e.g., benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles; mercaptopyrimidines; mercaptotrizaines; thioketo compounds, e.g., oxazolinethione; azaindenes, e.g., triazaindenes, tetraazaindenes (particularly 4-hydroxy-substituted (1,3,3a,7)tetraazaindenes), pentaazaindenes; benzenethiosulfonic acid; benzenesulfinic acid, benzenesulfonic acid amide, and various other compounds known as antifoggants or stabilizers. Preferred among them are benzotriazoles (e.g., 5-methylbenzotriazole) and nitroindazoles (e.g., 5-nitroindazole). These compounds may be incorporated into a processing solution.

The photographic material of the present invention may contain a developing agent, such as a hydroquinone derivative and phenidone derivative, as a stabilizer or an accelerator.

The photographic emulsion layers or any other hydrophilic colloidal layers of the light-sensitive materials of the invention can further contain organic or inorganic hardening agents, such as chromium salts (e.g., chrome alum, chromium acetate}, aldehydes (e.g., formaldehyde, glyoxal, glutaraldehyde), N-methylol compounds (e.g., dimethylolurea, methyloldimethylhydantoin), dixane derivatives (e.g., 2,3-dihydroxydioxane), active vinyl compounds (e.g., 1,3,5-triacryloylhexahydro-s-triazine, 1,3-vinylsulfonyl-2-propanol), active halogen compounds (e.g., 2,4-dichloro-6-hydroxy-s-trizine), mucohalogenic acids (e.g., mucochloric acid, mucophenoxychloric acid), and the like, either alone or in combinations thereof.

The photographic emulsion layers or other hydrophilic colloidal layers can furthermore contain various surface active agents for various purposes, such as coating aids, static charge prevention, improvement of slip properties, emulsification and dispersing aids, prevention of adhesion, improvement of photographic characteristics (e.g., development acceleration, increase in contrast, and increase in sensitivity), and the like. Examples of useful surface active agents include nonionic surface active agents, such as saponine (steroid type), alkylene oxide derivatives (e.g., polyethylene glycol, polyethylene glycol/polypropylene glycol condensates, polyethylene glycol alkyl ethers or alkylaryl ethers, polyethylene glycol esters, polyethylene glycol sorbitan esters, polyalkylene glycol alkylamines or alkylamides, polyethylene oxide adducts of silicone), glycidol derivatives (e.g., alkenylsuccinic acid polyglycerides, alkyl phenol polyglycerides), alkyl esters (e.g., fatty acid esters of polyhydric alcohols), anionic surface active agents containing an acid group (e.g., a carboxyl group, a sulfo group, a phospho group, a sulfate group, a phosphate group), such as alkylcarboxylates, alkylsulfonates, alkylbenzenesulfonates, alkylnaphthalene-sulfonates, alkylsulfates, alkylphosphates, N-acyl-N-alkyltaurines, sulfosuccinates, sulfoalkylpolyoxyethylene alkyl phenyl ethers, polyoxyethylene alkylphosphates; amphoteric surface active agents, such as amino acids, aminoalkylsulfonic acids, aminoalkyl sulfates or phosphates, alkylbetaines, amine oxides; and cationic surface active agents, such as alkylamine salts, aliphatic or aromatic quaternary ammonium salts, heterocyclic quaternary ammonium salts, e.g., pyridinium, imidazolium, aliphatic or heterocyclic phosphonium or sulfonium salts.

Surface active agents that are particularly preferred in the present invention are polyalkylene oxides having a molecular weight of 600 or more as described in JP-B-58-9412 (the term "JP-B" as used herein means an "examined published Japanese patent publication"). For use as antistatics, fluorine-containing surface active agents such as those described in JP-A-60-80849 are suitable.

The photographic emulsion layers or other hydrophilic colloidal layers of the photographic material may further contain a hydroquinone derivative capable of releasing a development inhibitor upon development in proportion to the image density ("DIR-hydroquinone"). Specific examples of the DIR-hydroquinone are described in U.S. Pat. Nos. 3,379,529, 3,620,746, 4,377,634, and 4,332,878, JP-A-54-67419, 56-153336, 56-153342, 59-278853, 59-90435, 59090436, and 59-138808.

For the purpose of preventing adhesion, the photographic emulsion layers or other hydrophilic colloidal layers can contain a matting agent, such as silica, magnesium oxide or polymethyl methacrylate particles.

For the purpose of improving dimensional stability, the photographic material can contain a dispersion of a water-soluble or sparingly water-soluble synthetic polymer, such as homo- or copolymers of an alkyl (meth)acrylate, an alkoxyacryl (meth)acrylate, glycidyl (meth-)acrylate, and copolymers of a combination of these monomers and acrylic acid or methacrylic acid.

It is preferable to incorporate into the photographic emulsion layers or other layers a compound having an acid group. The compound having an acid group includes organic acids, e.g., salicylic acid, acetic acid, monomer unit, e.g., acrylic acid, maleic acid or phthalic acid. The details of these compounds are described in Japanese Patent Application Nos. 60-66179, 60-68873, 60-163856, and 60-195655. Particularly preferred are ascorbic acid for low-molecular compounds and an aqueous latex of a copolymer containing an acid monomer (e.g., acrylic acid) and a crosslinking monomer having at least two unsaturated groups (e.g., divinylbenzene) for high-molecular compounds.

Photographic characteristics of ultra-high contrast and high sensitivity can be achieved by development processing of the silver halide light-sensitive materials according to the present invention with a stable developing solution without using such special developing solution as conventional infectious developers and highly alkaline developers at a pH near 13 as described in U.S. Pat. No. 2,419,975.

That is, the silver halide light-sensitive materials of the invention can be developed with a developer containing not less 0.15 mol/l, preferably 0.15 to 2.5 mol/l of sulfite ion as a preservative and having a pH of from 10.5 to 12.3, and particularly from 11.0 to 12.0, thereby to obtain a negative image having sufficiently high contrast.

Developing agents which can be used in the developer are not particularly limited. From the standpoint of the ease of obtaining satisfactory dot quality, the developer preferably contains a dihydroxybenzene developing agent. A combination of a dihydroxybenzene developing agent and 1-phenyl-3-pyrazolidone (or its derivative) or p-aminophenol (or its derivative) is employed in some cases.

The dihydroxybenzene developing agent includes hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone, with hydroquinone being particularly preferred.

Specific examples of the 1-phenyl-3-pyrazolidone or its derivatives are 1-phenyl-3-pyrazolidone, 1-phenyl-4,4-dimethyl-4-pyrazolidone, 1-phenyl-4-methyl-4-hydroxymethyl 3-pyrazolidone, 1-phenyl 4,4-dihydroxymethyl-3-pyrazolidone, 1-phenyl-5-methyl-3-pyrazolidone, 1-p-aminophenyl- 4,4-dimethyl-3-pyrazolidone, and 1-p-tolyl-4,4-dimethyl-3-pyrazxolidone.

Specific examples of the p-aminophenol developing agents are N-methyl-p-aminophenol, p-aminophenol, N-(β-hydroxyethyl)-p-aminophenol, N-(4-hydroxyphenyl)-glycine, 2-methyl-p-aminophenol and p-benzylaminophenol, with N-methyl-p-aminophenol being particularly preferred.

The developing agent is typically used in a concentration of from 0.05 to 0.8 mol/l. In case of using a combination of a dihydroxybenzene compounds and a 1-phenyl-3-pyrazolidone compound or p-aminophenol compound, the former is preferably used in a concentration of from 0.05 to 0.5 mol/l, and the latter not more than 0.06 mol/l.

The sulfite serving as a preservative in the developer includes sodium sulfite, potassium sulfite, lithium sulfite, ammonium sulfite, sodium bisulfite, potassium metabisulfite and formaldehyde sodium bisulfite. The sulfite is preferably used in an amount of from 0.4 mol/l, particularly from 0.5 mol/l to 2.5 mol/l.

The developer is adjusted to a pH between 10.5 and 12.3. An alkali agent used for pH adjustment includes a pH adjustor or a buffering agent, such as sodium hydroxide, potassium hydroxide, sodium carbonate, potassium carbonate, sodium tertiary phosphate, and potassium tertiary phosphate.

The developer can further contain various additives including development inhibitors (e.g., boric acid, borax, sodium bromide, potassium bromide, and potassium iodide); organic solvents (e.g., ethylene glycol, diethylene glycol, triethylene glycol, dimethylformamide, methyl cellosolve, hexylene glycol, ethanol, and methanol); antifoggants or black pepper inhibitors [e.g., 1-phenyl-5-mercaptotetrazole, indazole compounds (e.g., 5-nitroindazole), and benzotriazoles (e.g., 5-methylbenzotriazole)]. If desired, the developer may furthermore contain water softeners, toning agents, surface active agents, defoaming agents, hardening agents, and the amino compounds described in JP-A-No. 56-106244.

The developer may contain the compounds described in JP-A-No. 56-24347 as a silver stain inhibitor and the compounds described in JP-A-No. 60-109743 as dissolution aid. Further, the compounds described in JP-A-No. 60-93433 and Japanese Patent Application No. 61-28708 can be used as a buffering agent.

A fixer which can be used in the present invention has any commonly employed composition. Fixing agents used include thiosulfates, thiocyanates, and other organic sulfur compounds known to have fixing effects. The fixer may contain a water-soluble aluminum salt (e.g., aluminum sulfate) as a hardening agent. Such a water-soluble aluminum salt is usually used in an amount of from 0.4 g to 2.0 g as aluminum per liter. In addition, a complex of a trivalent iron compound with ethylenediaminetetraacetic acid can be used as an oxidizing agent.

Development processing of the light-sensitive material of the present invention is usually performed at a temperature between 18° and 50° C., preferably between 25° and 43° C.

The present invention is now illustrated in greater detail with reference to the following Examples and Comparative Examples, but the present invention is not to be construed as being limited thereto. Unless otherwise indicated, all parts, percents and ratios are by weight.

EXAMPLES

In these examples, a developer having the following formulation was used.

Developer Formulation

| | |
|---|---|
| Hydroquinone | 45.0 g |

-continued

| | |
|---|---|
| N-Methyl-p-aminophenol ½ sulfate | 0.8 g |
| Sodium hydroxide | 18.0 g |
| Potassium hydroxide | 55.0 g |
| 5-Sulfosalicylic acid | 45.0 g |
| Boric acid | 25.0 g |
| Potassium sulfite | 110.0 g |
| Disodium ethylenediaminetetraacetate | 1.0 g |
| Potassium bromide | 6.0 g |
| 5-Methylbenzotriazole | 0.6 g |
| n-Butyldiethanolamine | 15.0 g |
| Water to make | 1 l (pH 11.6) |

EXAMPLE 1

Emulsions A, B and C were prepared as is shown below.

Preparation of Emulsion A

To 1 liter of aqueous gelatin solution containing 20 g of gelatin kept at 50° C. was added potassium hexachloroiridate (III), and an aqueous solution of silver nitrate and an aqueous solution of potassium iodide and potassium bromide were added thereto simultaneously in the presence of ammonia over a period of 60 minutes while maintaining the system at a pAg of 7.8. The amount of the added potassium hexachloroiridate (III) was $4\times10^{-7}$ mol per mol of silver. There was obtained a mono disperse emulsion of cubic silver iodobromide grains having a mean silver iodide content of 2 mol % and a mean grain size of 0.25 μm. The emulsion was desalted according to a flocculation method. Hypo ($1.3\times10^{-4}$ mol per mol of Ag) was added to the emulsion, and the emulsion was subjected to chemical ripening at 60° C.

Preparation of Emulsion B

A mono disperse cubic silver iodobromide emulsion having a mean silver iodide content of 0.1 mol % and a mean grain size of 0.25 μm was prepared in the same manner as Emulsion A, except for varying the amount of ammonia. The emulsion was desalted by a flocculation method. After addition of hypo, the emulsion was subjected to chemical ripening at 60° C.

Preparation of Emulsion C

A mono disperse cubic silver iodobromide emulsion having a mean silver iodide content of 2 mol % and a mean grain size of 0.3 μm was prepared in the same manner as for Emulsion A, except for varying the amount of ammonia. The emulsion was then desalted in a flocculation method.

Preparation of Sample

To each of Emulsions A, B, and C was added $3\times10^{-4}$ mol per mol of silver of 5-[3-(4-sulfobutyl)-5-chloro-2-oxazolidylidene]-1-hydroxyethoxyethyl-3-(2-pyridyl)-2-thiohydantoin as a sensitizing dye. Each of the compounds of formula (I) or comparative compounds shown in Table I below and then each of the hydrazine derivatives of formula (II) shown in the Table were added thereto. Further, $7\times10^{-4}$ mol per mol of silver of 4-hydroxy-6-methyl-1,3,3a,7-tetreazaindene, $1\times10^{-2}$ mol per mol of silver of hydroquinone, 50 mg per $m^2$ of polyethylene glycol (molecular weight: 1000), 500 mg per $m^2$ of polyethyl acrylate dispersion, and 1,3-divinylsulfonyl-2-propanol were added to the emulsion. The resulting coating composition was coated on a polyethylene terephthalate film to a silver coverage of 3.4 g/$m^2$ (gelatin coverage: 2 g/$m^2$) together with a protective layer containing 1.3 g/$m^2$ of gelatin, 50 mg/$m^2$ of polymethyl methacrylate particles (particle diameter: 2.5 μm), methanol, 0.15 g/$m^2$ of silica, and, as coating aid, a fluorine-containing surface active agent $$\text{(formula: } C_8F_{17}SO_2\underset{\underset{C_3H_7}{|}}{N}CH_2COOK\text{)}$$

and sodium dodecylbenzenesulfonate.

Evaluation

(1) Photographic Characteristics

Each of the resulting samples was exposed to light and developed with the above-described developer under Condition I or II described below, and the sensitivity, gamma, and maximum density ($D_{max}$) of the developed sample were evaluated. The sensitivity value is the reciprocal of the exposure amount which provided a density of 1.5 after development at 38° C. for 30 seconds, relative to the result of Sample 1 as a standard (100).

Condition I

The development was carried out at 38° C. for 30 seconds by means of an automatic developing machine ("FG-660" manufactured by Fuji Photo Film Co., Ltd.).

Condition II

The conditions of the development were the same as (1) above, except for using a developer fatigued from processing of 150 films of "Fuji Lith Orthochromatic Film GO-100" (produced by Fuji Photo Film Co., Ltd.) of size (50.8 cm×61 cm)having a degree of blacking of 100%.

(2) Black Pepper

Each of the samples was development processed using the above developer fatigued with time by standing without replenishment for one week until the pH increased by 0.05 and the sulfite ion concentration decreased to the half of that of the fresh developer.

The black pepper appearance was microscopically observed and graded from 1 (the worst) to 5 (the best). Samples graded 5 or 4 are suitable for practical use; samples graded 3 are of the lowest possible quality for practical use; and samples graded 2 or 1 are impractical. Samples ranking between 4 and 3 were graded 3.5.

(3) Residual Color

The sample was development-processed under the same conditions of Condition I, except for changing the development time to 20 seconds, and the tone of the unexposed area was visually observed and graded from 1 (the worst) to 5 (the best).

The results obtained are shown in Table 1.

TABLE 1

| Sample No. | Emulsion | Compound of (I) Compound No. | Compound of (I) Amount (mol/mol-Ag) | Compound of (II) Compound No. | Compound of (II) Amount (mol/mol-Ag) | Condition I Sensitivity | Condition I Gamma | Condition I $D_{max}$ | Condition II Sensitivity | Condition II Gamma | Condition II $D_{max}$ | Black Pepper | Residual Color | Remark |
|---|---|---|---|---|---|---|---|---|---|---|---|---|---|---|
| 1 | A | — | — | — | — | 100 | 18.0 | 6.2 | 91 | 16.0 | 5.6 | 1 | 5 | Comparison |
| 2 | " | I-3 | $2 \times 10^{-4}$ | II-5 | $3 \times 10^{-3}$ | " | 18.0 | 6.2 | 91 | 16.0 | 5.5 | 4 | 5 | Invention |
| 3 | " | " | $4 \times 10^{-4}$ | " | " | 95 | 17.2 | 6.1 | 87 | 15.0 | 5.4 | 5 | 5 | " |
| 4 | " | " | $2 \times 10^{-4}$ | " | $3.3 \times 10^{-3}$ | 105 | 18.2 | 6.2 | 98 | 16.2 | 5.6 | 4 | 5 | " |
| 5 | " | " | $4 \times 10^{-4}$ | " | " | 100 | 17.8 | 6.2 | 91 | 16.0 | 5.6 | 4.5 | 5 | " |
| 6 | " | I-15 | $2 \times 10^{-4}$ | " | $3 \times 10^{-3}$ | " | 17.5 | 6.0 | 91 | 15.9 | 5.6 | 4 | 5 | " |
| 7 | " | " | $4 \times 10^{-4}$ | " | " | 93 | 17.0 | 5.9 | 85 | 15.6 | 5.5 | 5 | 5 | " |
| 8 | B | " | $2 \times 10^{-4}$ | " | " | 98 | 18.0 | 6.2 | 87 | 14.3 | 5.0 | 4 | 5 | " |
| 9 | " | " | $4 \times 10^{-4}$ | " | " | 93 | 17.0 | 6.1 | 79 | 13.5 | 4.6 | 5 | 5 | " |
| 10 | A | Compound (a) | $2 \times 10^{-4}$ | " | $3 \times 10^{-3}$ | 100 | 17.2 | 6.1 | 91 | 15.2 | 5.4 | 2 | 3 | Comparison |
| 11 | " | " | $4 \times 10^{-4}$ | " | " | 93 | 16.8 | 5.8 | 85 | 14.8 | 5.3 | 2.5 | 1 | " |
| 12 | " | Compound (b) | $2 \times 10^{-4}$ | " | $3 \times 10^{-3}$ | 98 | 16.6 | 5.7 | 83 | 14.6 | 5.3 | 1.5 | 5 | " |
| 13 | " | " | $4 \times 10^{-4}$ | " | " | 91 | 15.0 | 5.6 | 79 | 13.5 | 5.2 | 2 | 5 | " |
| 14 | " | — | — | II-13 | $2 \times 10^{-4}$ | 105 | 18.2 | 6.2 | 100 | 16.8 | 5.6 | 1 | 5 | " |
| 15 | " | I-3 | $2 \times 10^{-4}$ | " | " | 105 | 18.0 | 6.1 | 100 | 16.0 | 5.6 | 4 | 5 | Invention |
| 16 | " | " | $4 \times 10^{-4}$ | " | " | 95 | 16.8 | 5.9 | 87 | 14.9 | 5.5 | 5 | 5 | Invention |
| 17 | " | " | " | " | $3 \times 10^{-4}$ | 100 | 17.8 | 6.1 | 91 | 15.6 | 5.6 | 4 | 5 | " |
| 18 | C | — | — | II-5 | $3 \times 10^{-3}$ | 98 | 16.2 | 4.5 | 91 | 14.0 | 4.0 | 3 | 5 | Comparison |
| 19 | " | — | — | " | $3.3 \times 10^{-3}$ | 102 | 17.0 | 4.6 | 93 | 14.6 | 4.2 | 2.5 | 5 | " |
| 20 | " | I-3 | $2 \times 10^{-4}$ | " | $3 \times 10^{-3}$ | 98 | 16.0 | 4.5 | 87 | 14.2 | 4.0 | 5 | 5 | " |
| 21 | " | " | $4 \times 10^{-4}$ | " | " | 95 | 15.2 | 4.4 | 87 | 14.0 | 3.8 | 5 | 5 | " |
| 22 | " | " | " | " | $3.3 \times 10^{-3}$ | 100 | 16.2 | 4.5 | 91 | 14.0 | 4.0 | 5 | 5 | " |

Note:

Comparative Compoud (a)

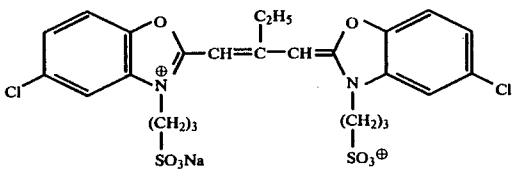

Comparative Compoud (b)

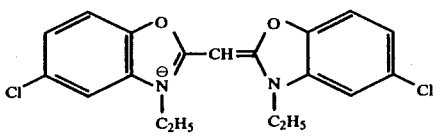

As is apparent from Table 1, Samples 2 to 9 and 15 to 17 according to the present invention had a high maximum density and retained the high maximum density even when developed with a developer having been used for processing a large volume of films. Further, these samples proved satisfactory in freedom from black pepper even when processed with a fatigued developer having an increased pH and a decreased sulfite ion concentration. To the contrary, Comparative Samples 18 to 22, in which an emulsion without chemical sensitization (Emulsion C) was employed, showed insufficient maximum densities.

While the invention has been described in detail and with reference to specific embodiments thereof, it will be apparent to one skilled in the art that various changes and modifications can be made therein without departing from the spirit and scope thereof.

What is claimed is:

1. A negative silver halide photographic material comprising a support having thereon at least one chemically sensitized silver halide emulsion layer, at least one hydrophilic colloidal layer of the material containing a hydrazine derivative and a compound having substantially all absorption maxima outside the visible light region represented by formula (I):

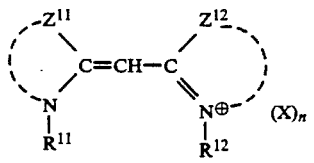

(I)

wherein $Z^{11}$ and $Z^{12}$, which may be the same or different, each represents a non-metallic atomic group necessary for completing a substituted or unsubstituted heterocyclic ring selected from benzoxazole, benzothiazole, benzoselenazole, naphthoxazole, naphthothiazole, naphthoselenazole, thiazole, thiazoline, oxazole, selenazole, selenazoline, pyridine, benzimidazole, and quinoline; $R^{11}$ and $R^{12}$, which may be the same or different, each represents a substituted or unsubstituted alkyl group, provided that at least one of $R^{11}$ and $R^{12}$ is substituted with an acid group; X represents a counter ion required for charge balance; and n is 0 or 1.

2. The negative silver halide photographic material as claimed in claim 1, wherein said heterocyclic ring formed by $Z^{11}$ and $Z^{12}$ in formula (I) is benzoxazole, benzothiazole, naphthoxazole, naphthothiazole, thiazole or oxazole.

3. The negative silver halide photographic material as claimed in claim 2, wherein said heterocyclic ring formed by $Z^{11}$ and $Z^{12}$ in formula (1) is benzoxazole, benzothiazole or naphthoxazole.

4. The negative silver halide photographic material as claimed in claim 3, wherein said heterocyclic ring formed by $Z^{11}$ and $Z^{12}$ in formula (I) is benzoxazole or naphthoxazole.

5. The negative silver halide photographic material as claimed in claim 1, wherein said alkyl group represented by $R^{11}$ and $R^{12}$ is an unsubstituted alkyl group containing at most 18 carbon atoms or a substituted alkyl group containing at most 6 carbon atoms in the alkyl moiety.

6. The negative silver halide photographic material as claimed in claim 5, wherein said alkyl group represented by $R^{11}$ and $R^{12}$ is an unsubstituted alkyl group containing at most eight carbon atoms or a substituted alkyl group containing at most eight carbon atoms in the alkyl moiety.

7. The negative silver halide photographic material as claimed in claim 5, wherein said acid group substituent for $R^{11}$ and $R^{12}$ is a carboxyl group or a sulfo group.

8. The negative silver halide photographic material as claimed in claim 1, wherein said hydrazine derivative is represented by formula (II):

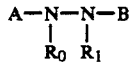

(II)

wherein A represents an aliphatic group or an aromatic group; B represents a formyl group, an acyl group, an alkylsulfonyl group, an arylsulfonyl group, an alkylsulfinyl group, an arylsulfonyl group, a carbamoyl group, an alkoxycarbonyl group, an aryloxycarbonyl group, a sulfinamoyl group, an alkoxysulfonyl group, a thioacyl group, a thiocarbamoyl group, a sulfamoyl group, or a heterocyclic group; and $R_0$ and $R_1$, which may be the same or different, each represents hydrogen, a substituted or unsubstituted alkylsulfonyl group, a substituted or unsubstituted arylsulfonyl group, or a substituted or unsubstituted acyl group, provided that at least one of $R_0$ and $R_1$ represents hydrogen; or B and $R_1$ may be connected each other to form a partial structure of a hydrazone structure together with the adjacent nitrogen atom.

9. The negative silver halide photographic material as claimed in claim 8, wherein A represents a substituted or unsubstituted alkyl group containing from 1 to 20 carbon atoms, or a substituted or unsubstituted aromatic group selected from benzene, naphthalene, pyridine, pyrimidine, imidazole, pyrazole, quinoline, isoquinoline, benzimidazole, thiazole and benzothiazole.

10. The negative silver halide photographic material as claimed in claim 9, wherein A represents an aryl group.

11. The negative silver halide photographic material as claimed in claim 8, wherein B represents a formyl group or an acyl group.

12. The negative silver halide photographic material as claimed in claim 8, wherein $R_0$ and $R_1$, which may be the same or different, each represents hydrogen, an alkylsulfonyl group containing at most 20 carbon atoms, an arylsulfonyl group containing at most 20 carbon atoms, an acyl group containing at most 20 carbon atoms, an unsubstituted aliphatic acyl group, or an aliphatic acyl group substituted with a substituent selected from a halogen atom, an ether group, a sulfonamido group, a carbonamido group, a hydroxyl group, a carboxyl group and a sulfo group.

13. The negative silver halide photographic material as claimed in claim 12, wherein $R_0$ and $R_1$ each represents hydrogen.

14. The negative silver halide photographic material as claimed in claim 1, wherein said hydrazine derivative and said compound represented by formula (I) are both contained in said silver halide emulsion layer.

15. The negative silver halide photographic material as claimed in claim 1, wherein said compound represented by formula (I) is present in an amount of from $1\times10^{-6}$ to $1\times10^{-2}$ mol per mol of the total silver halide.

16. The negative silver halide photographic material as claimed in claim 1, wherein said hydrazine derivative is present in an amount of from $1\times10^{-6}$ to $1\times10^{-1}$ mol per mol of the total silver halide.

17. The negative silver halide photographic material as claimed in claim 1, wherein said silver halide emulsion comprises silver iodobromide containing at most 10 mol % of silver iodide.

18. The negative silver halide photographic material as claimed in claim 17, wherein said silver iodobromide contains from 0.4 to 3.5 mol % of silver iodide.

19. A method for forming an image comprising the steps of:

(a) imagewise exposing a silver halide photographic material comprising a support having thereon at least one chemically sensitized silver halide emulsion layer, at least one hydrophilic colloidal layer of the material containing a hydrazine derivative and a compound having substantially all absorption maxima outside the visible light region represented by formula (I):

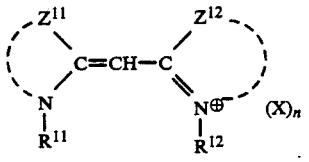

(I)

wherein $Z^{11}$ and $Z^{12}$, which may be the same or different, each represents a non-metallic atomic group necessary for completing a substituted or unsubstituted heterocyclic ring selected from benzoxazole, benzothiazole, benzoselenazole, naphthoxazole, naphthothiazole, naphthoselenazole, thiazole, thiazoline, oxazole, selenazole, selenazoline, pyridine, benzimidazole, and quinoline; $R^{11}$ and $R^{12}$, which may be the same or different, each represents a substituted or unsubstituted alkyl group, provided that at least one of $R^{11}$ and $R^{12}$ is substituted with an acid group; X represents a counter ion required for charge balance; and n is 0 or 1; and (b) developing said exposed silver halide photographic material with a developer solution having a sulfite ion concentration of at least 0.15 mol/l and a pH of from 10.5 to 12.3 to form a negative image.

20. The method as claimed in claim 19, wherein said developer solution has a sulfite ion concentration of from 0.15 mol/l to 2.5 mol/l and a pH of from 11.0 to 12.0.

21. The negative silver halide photographic material as claimed in claim 1, wherein $R^{11}$ and $R^{12}$ each represents a substituted or unsubstituted alkyl group, both of which alkyl groups are substituted with an acid group.

* * * * *